US007690857B2

(12) United States Patent
Key

(10) Patent No.: US 7,690,857 B2
(45) Date of Patent: Apr. 6, 2010

(54) STORM DRAIN RELIEF CHANNEL AND ASSOCIATED METHODS OF MANUFACTURE AND USE

(76) Inventor: William B. Key, 1226 Manicott Dr., Matthews, NC (US) 28105

( * ) Notice: Subject to any disclaimer, the term of this patent is extended or adjusted under 35 U.S.C. 154(b) by 787 days.

(21) Appl. No.: 11/414,413

(22) Filed: Apr. 28, 2006

(65) Prior Publication Data

US 2007/0014632 A1 Jan. 18, 2007

Related U.S. Application Data

(60) Provisional application No. 60/699,188, filed on Jul. 14, 2005.

(51) Int. Cl.
*E01F 5/00* (2006.01)
*E01C 11/22* (2006.01)

(52) U.S. Cl. ..... 404/5; 404/4; 210/170.03

(58) Field of Classification Search ..... 210/163, 210/164, 170.03; 404/2, 4, 5; 405/39, 40, 405/51

See application file for complete search history.

(56) References Cited

U.S. PATENT DOCUMENTS 947,817 A * 2/1910 Hayes ..... 210/307
4,986,693 A * 1/1991 Salberg et al. ..... 404/4
5,571,407 A * 11/1996 Kato ..... 210/164
6,797,162 B2 * 9/2004 Happel ..... 210/163
6,869,525 B1 * 3/2005 Happel ..... 210/163
6,997,636 B2 * 2/2006 Tremouilhac ..... 404/5
7,309,420 B1 * 12/2007 Trangsrud ..... 210/163
7,459,090 B1 * 12/2008 Collings ..... 210/747

* cited by examiner

*Primary Examiner*—Gary S Hartmann
(74) *Attorney, Agent, or Firm*—Clements Bernard PLLC; Christopher L. Bernard; Lawrence A. Baratta, Jr.

(57) ABSTRACT

A storm drain relief channel for providing fluid/debris access from the surface of a road to the interior portion of a catch basin including a rigid box structure includes a substantially-hollow channel structure disposed adjacent to the rigid box structure of a curb inlet, the substantially-hollow channel structure having a first end defining a first opening and a second end defining a second opening, wherein the first end is configured to be disposed adjacent to and substantially flush with, and in fluid/debris communication with, the surface of the road and the second end is configured to be disposed one of adjacent to and within, and in fluid/debris communication with, the interior portion of the curb inlet.

15 Claims, 9 Drawing Sheets

FIG. 1. – PRIOR ART

FIG. 2. – PRIOR ART

STORM DRAIN RELIEF CHANNEL AND ASSOCIATED METHODS OF MANUFACTURE AND USE

CROSS-REFERENCE TO RELATED APPLICATION(S)

The present non-provisional patent application claims the benefit of priority of U.S. Provisional Patent Application No. 60/699,188, filed on Jul. 14, 2005 (William B. KEY), and entitled "STORM DRAIN RELIEF CHANNEL," which is incorporated in-full by reference herein.

FIELD OF THE INVENTION

The present invention relates generally to the road construction and infrastructure development fields, among others. More specifically, the present invention relates to a storm drain relief channel that is configured to enhance the performance of conventional storm sewers or drains, catch basins, curb inlets, and the like. Finally, the present invention relates to an improved storm sewer or drain, catch basin, curb inlet, or the like.

BACKGROUND OF THE INVENTION

It is a code requirement in many municipalities that when an asphalt road having concrete curbs and gutters, and metal curb inlets or the like, (collectively, storm sewers or drains) is installed, the surface of the asphalt road must be left down approximately 1 inch relative to the surface of the concrete curbs and gutters for a given period of time. This may also be done voluntarily, such that the eventual surface of the asphalt road, when finished, is not damaged by construction vehicles and looks smooth and uniform. This creates an undesirable situation in which the curb inlets associated with the storm sewers or drains, which are flush with the surface of the concrete curbs and gutters, and which are preferably flush with the surface of the asphalt road, protrude approximately 1 inch above the surface of the asphalt road for a given period of time. As a result, water and debris are temporarily unable to flow into the storm sewers or drains and collect on the surface of the asphalt road adjacent to the storm sewers or drains. In addition to being a general nuisance, the water can freeze, creating a hazardous condition and potential liability.

One conventional solution to this problem is to punch holes in the surface of the asphalt road adjacent to the storm sewers or drains, creating an alternate channel for the water and debris to flow into the storm sewers or drains (in addition to the primary grates associated with the curb inlets). These holes, however, are prone to clogging and deteriorating. Thus, this solution is inadequate and what is needed is a better way to channel water and debris into storm sewers or drains while the 1-inch leave-down is required.

BRIEF SUMMARY OF THE INVENTION

In various exemplary embodiments, the present invention provides a storm drain relief channel that is configured to enhance the performance of conventional storm sewers or drains, catch basins, curb inlets, and the like. The present invention also provides an improved storm sewer or drain, catch basin, or curb inlet design.

In one exemplary embodiment of the present invention, a storm drain relief channel for providing fluid/debris access from the surface of a road to the interior portion of a catch basin including a rigid box structure includes a substantially-hollow channel structure disposed adjacent to the rigid box structure of a curb inlet, the substantially-hollow channel structure having a first end defining a first opening and a second end defining a second opening, wherein the first end is configured to be disposed adjacent to and substantially flush with, and in fluid/debris communication with, the surface of the road and the second end is configured to be disposed one of adjacent to and within, and in fluid/debris communication with, the interior portion of the curb inlet.

In another exemplary embodiment of the present invention, a method for installing/manufacturing a storm drain relief channel for providing access from the surface of a road to the interior portion of a catch basin including a rigid box structure includes disposing a substantially-hollow channel structure adjacent to the rigid box structure of a curb inlet, the substantially-hollow channel structure having a first end defining a first opening and a second end defining a second opening, wherein the first end is configured to be disposed adjacent to and substantially flush with, and in fluid/debris communication with, the surface of the road and the second end is configured to be disposed one of adjacent to and within, and in fluid/debris communication with, the interior portion of the curb inlet.

In a further exemplary embodiment of the present invention, a storm drain relief channel for providing access from the surface of a road to the interior portion of a catch basin including a rigid box structure includes a substantially-hollow trough structure disposed adjacent to the rigid box structure of a curb inlet, the substantially-hollow trough structure having a first end defining a first opening and a second end defining a second opening, wherein the first end is configured to be disposed adjacent to and substantially flush with, and in fluid/debris communication with, the surface of the road and the second end is configured to be disposed adjacent to, and in fluid/debris communication with, one or more passages provided through the rigid box structure of the curb inlet.

In a still further exemplary embodiment of the present invention, a storm drain relief channel for providing access from the surface of a road to the interior portion of a catch basin includes a rigid box structure defining a recessed portion along an edge thereof and a grate cover defining a recessed portion along an edge thereof, wherein the location of the recessed portion of the rigid box structure substantially corresponds to the location of the recessed portion of the grate cover, thereby defining a collective opening. Preferably, the recessed portion along the edge of the rigid box structure has a depth of between about 1 inch and about 3 inches.

BRIEF DESCRIPTION OF THE DRAWINGS

The present invention is illustrated and described herein with reference to the various drawings which depict preferred embodiments and specific examples thereof, in which like reference numbers denote like parts or components, as appropriate, and in which:

FIG. 1 is a side planar view illustrating a conventional curb inlet and catch basin utilizing a brick perimeter foundation which is disposed on a slab, masonry, or the like;

FIG. 2 is a top planar view illustrating a conventional curb inlet and catch basin utilizing a brick perimeter foundation which is disposed on a slab, masonry, or the like;

FIG. 3 is a side planar view illustrating a conventional curb inlet and catch basin used in conjunction with the storm drain relief channel of the present invention, the storm drain relief channel disposed at least partially through the brick perimeter foundation which is disposed on the slab, masonry, or the like;

FIG. 4 is a top planar view illustrating a conventional curb inlet and catch basin used in conjunction with the storm drain relief channel of the present invention, the storm drain relief channel disposed at least partially through the brick perimeter foundation which is disposed on the slab, masonry, or the like;

FIG. 8 is a side planar view illustrating one exemplary embodiment of the improved curb inlet and catch basin of the present invention utilizing a brick perimeter foundation which is disposed on a slab, masonry, or the like; and FIG. 9 is a top planar view illustrating another exemplary embodiment of the improved curb inlet and catch basin of the present invention utilizing a brick perimeter foundation which is disposed on a slab, masonry, or the like.

DETAILED DESCRIPTION OF THE INVENTION

As described above, in various exemplary embodiments, the present invention provides a storm drain relief channel that is configured to enhance the performance of conventional storm sewers or drains, catch basins, curb inlets, and the like. The present invention also provides an improved storm sewer or drain, catch basin, or curb inlet design.

Figure 1:
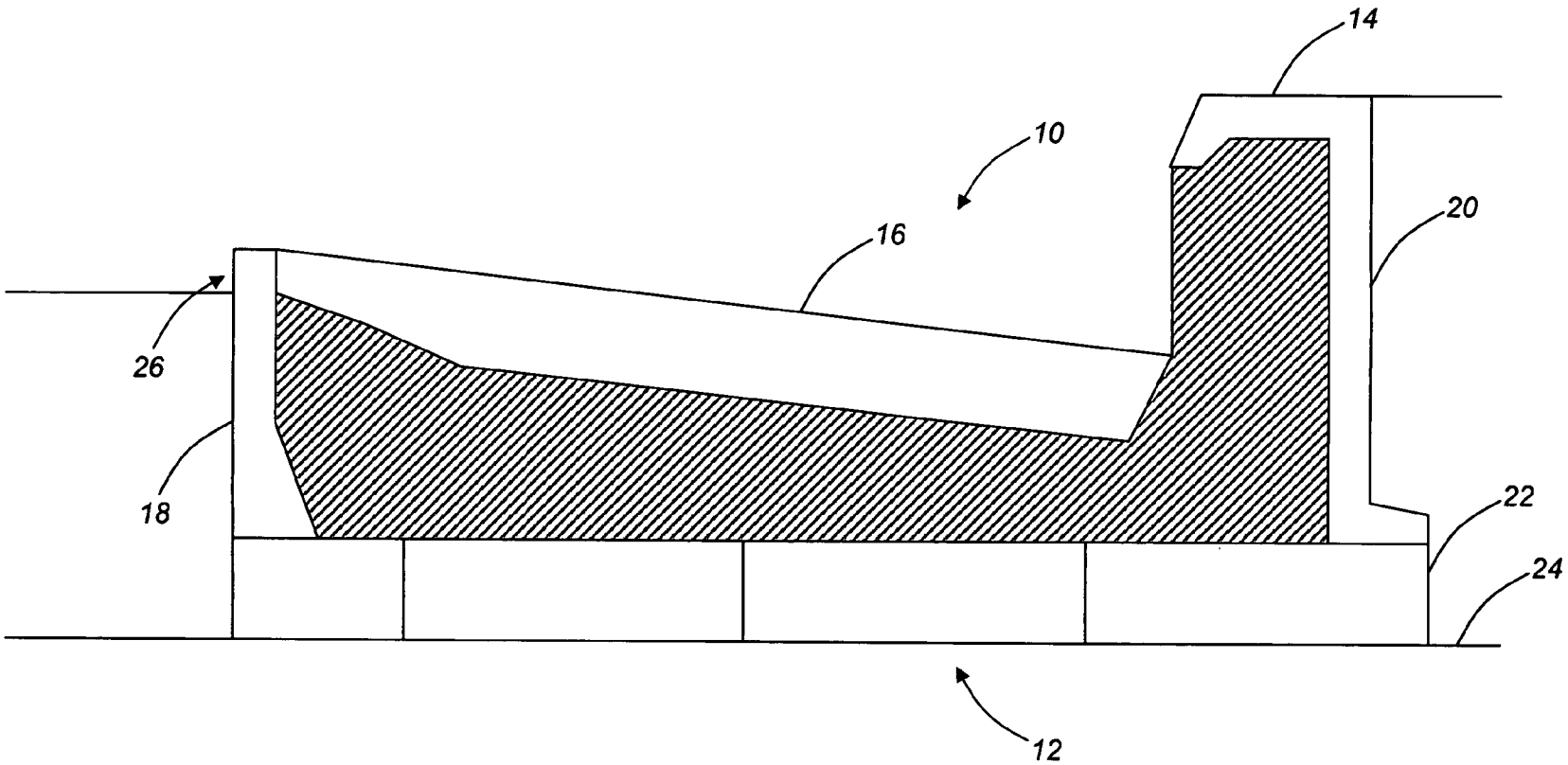
Figure 2:
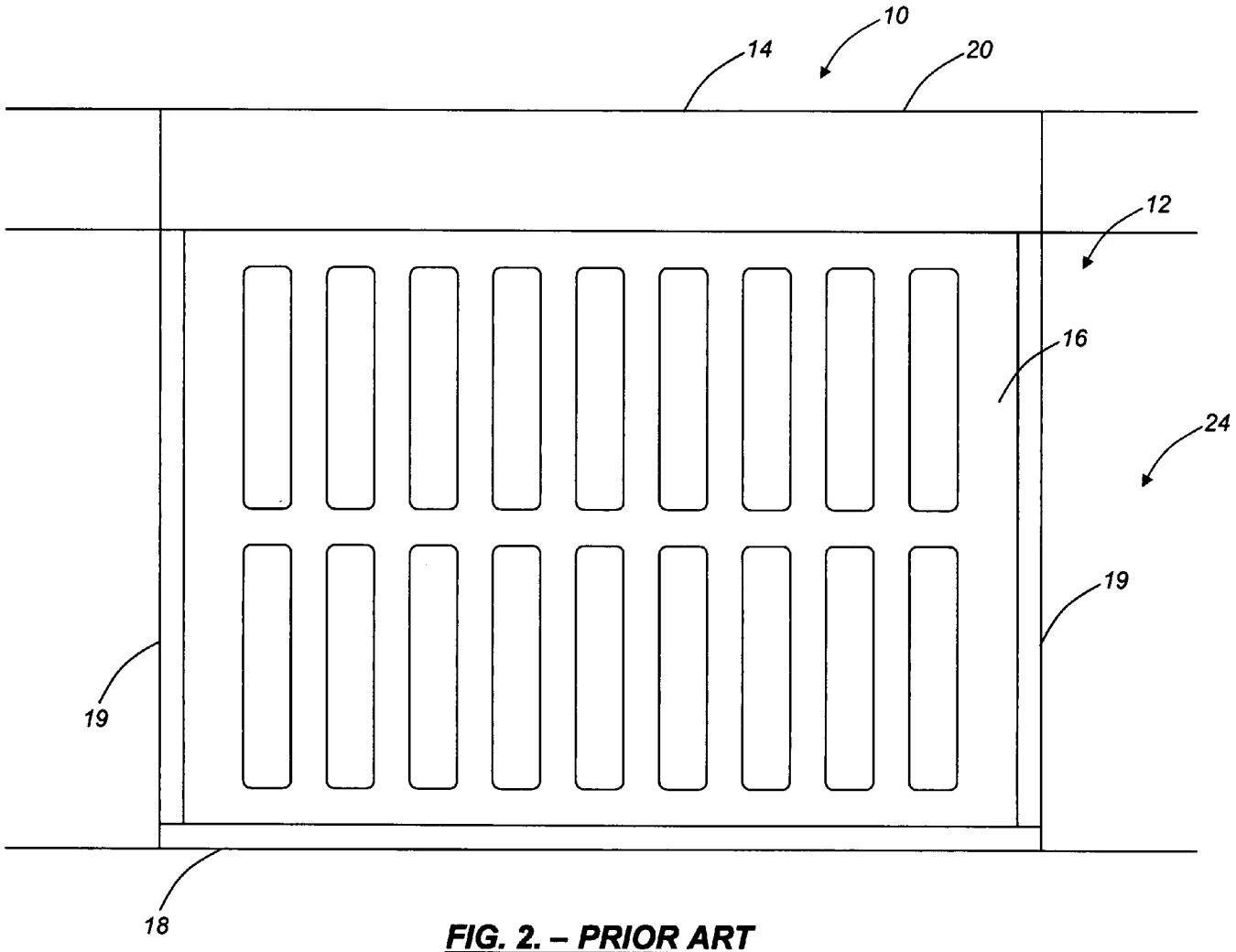

Referring to FIGS. 1 and 2, a conventional curb inlet 10 and catch basin 12 include a rigid box structure 14 having a grate cover 16 through which water and debris may pass. The rigid box structure 14 typically has a low, or road, side 18 and a high, or curb, side 20 (hood), as well as two other sides 19 (FIG. 2) (collectively, frame). The rigid box structure 14 is typically made of a hardened material, such as steel, cast iron, or the like. Optionally, the rigid box structure 14 is disposed on a perimeter foundation 22, such as a brick perimeter foundation or the like, which is disposed on a slab 24, masonry, or the like. The curb inlet 10 rests on the slab 24, which forms the bottom of the storm sewer or drain. It should be noted that other conventional curb inlet 10 and catch basin 12 designs exist and may be used in conjunction with the storm drain relief channel of the present invention. For example, the rigid box structure 14 may have any number of even or uneven sides, a perimeter foundation 22 may not be used, the sides and bottom of the curb inlet 10 and/or catch basin 12 may be integrally formed, etc.

As described above, it is a code requirement in many municipalities that when an asphalt road having concrete curbs and gutters, and metal curb inlets or the like, (collectively, storm sewers or drains) is installed, the surface of the asphalt road must be left down approximately 1 inch relative to the surface of the concrete curbs and gutters for a given period of time. This may also be done voluntarily, such that the eventual surface of the asphalt road, when finished, is not damaged by construction vehicles and looks smooth and uniform. This creates an undesirable situation in which the curb inlets associated with the storm sewers or drains, which are flush with the surface of the concrete curbs and gutters, and which are preferably flush with the surface of the asphalt road, protrude approximately 1 inch above the surface of the asphalt road for a given period of time. This 1-inch leave-down 26 is illustrated in FIG. 1. As a result, water and debris are temporarily unable to flow into the storm sewers or drains and collect on the surface of the asphalt road adjacent to the storm sewers or drains. In addition to being a general nuisance, the water can freeze, creating a hazardous condition and potential liability.

Figure 3:
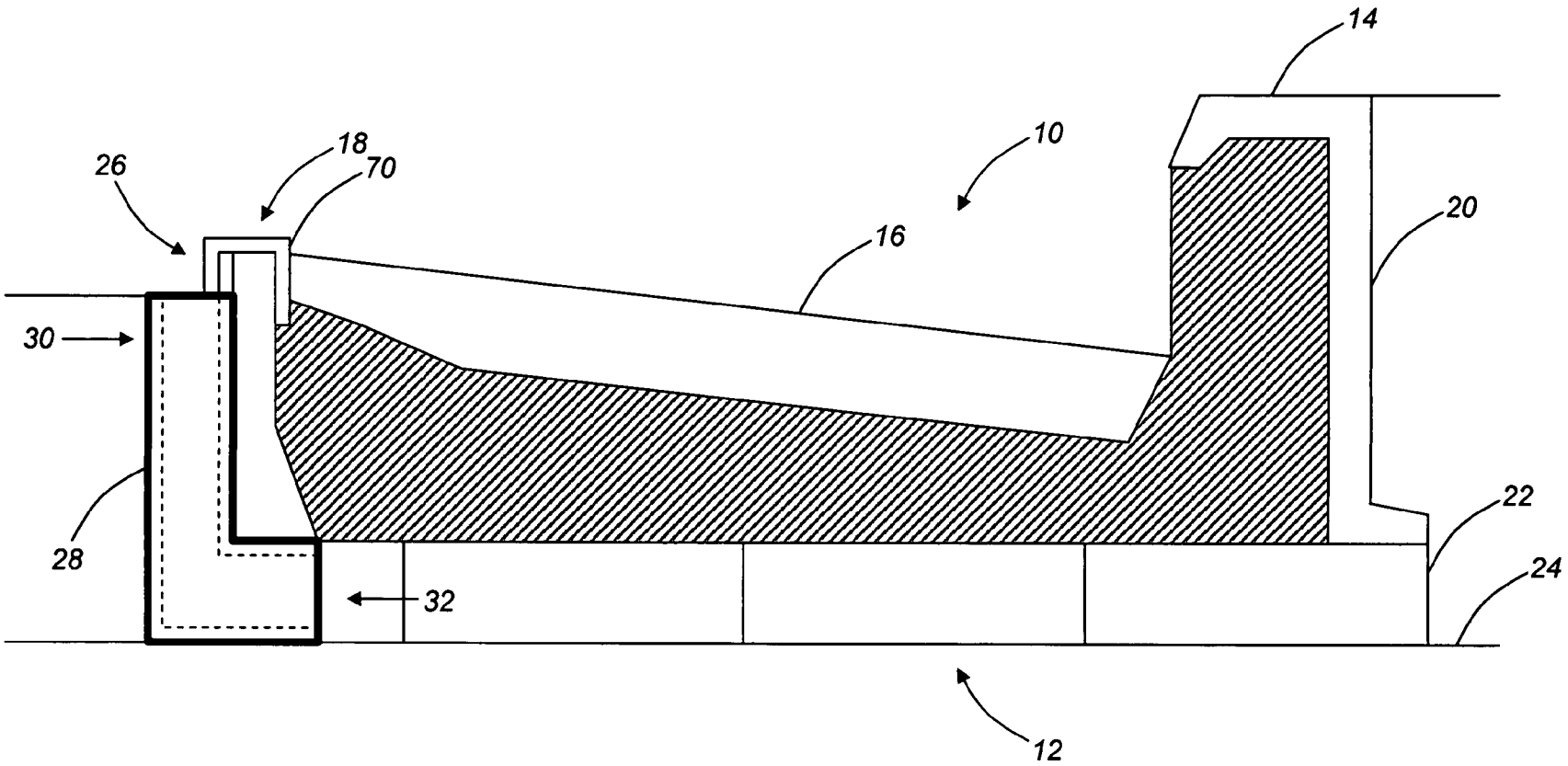
Figure 4:
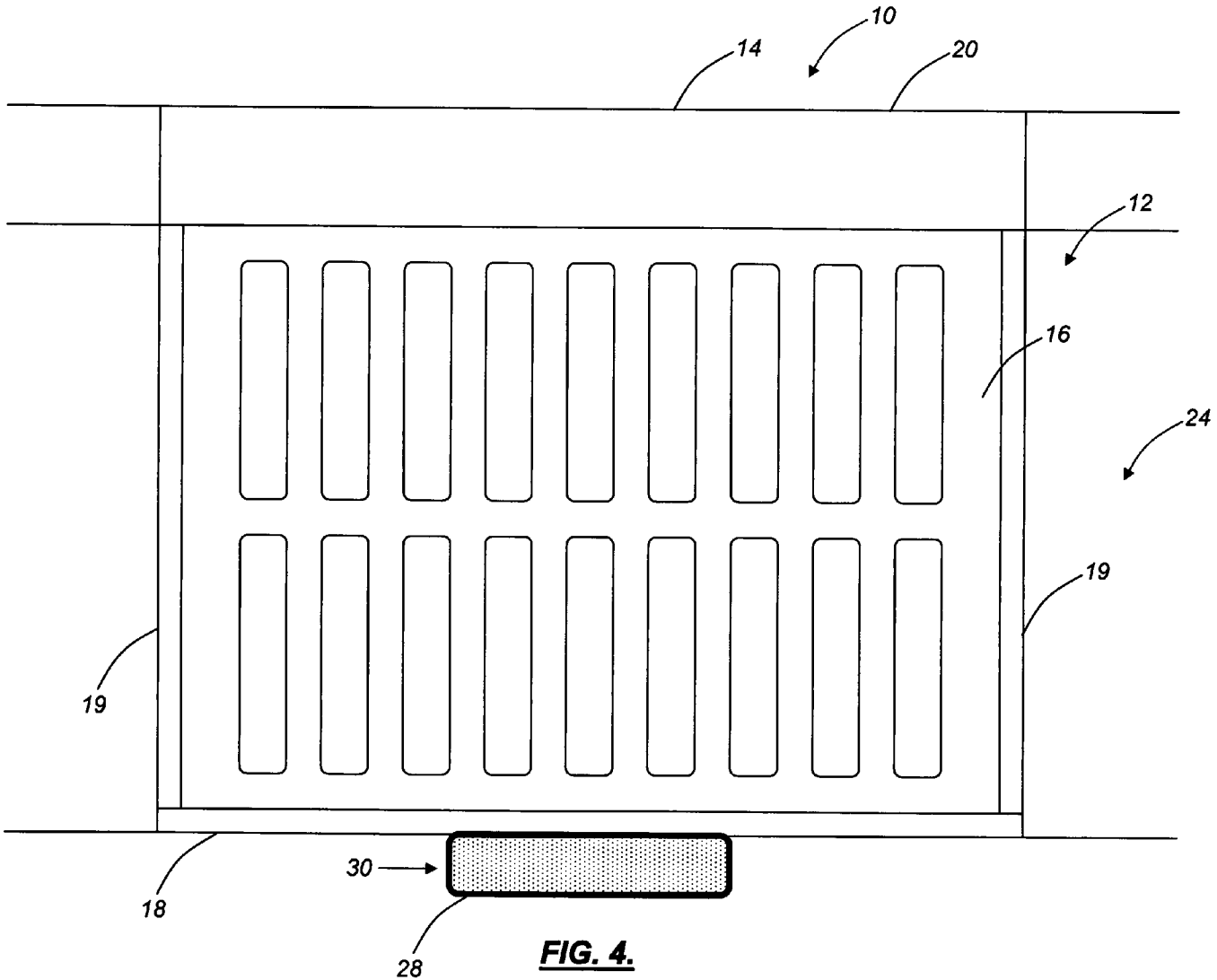

Referring to FIGS. 3 and 4, in one exemplary embodiment, the substantially-hollow storm drain relief channel 28 of the present invention is installed, during or subsequent to road construction, adjacent to the low, or road, side 18 of the rigid box structure 14 of the curb inlet 10, via one or more suitable fasteners. The top portion 30 of the storm drain relief channel 28 defines an opening that is disposed flush with the surface of the asphalt road in which the curb inlet 10 is installed. The bottom portion 32 of the storm drain relief channel 28 defines an opening that is disposed within the curb inlet 10 and/or catch basin 12, optionally through an opening formed in the perimeter foundation 22 or the low, or road, side 18 of the curb inlet 10 subsequent to or at the time of manufacture. Preferably, the storm drain relief channel 28 is made of a hardened material, such as steel, cast iron, a hardened plastic, or the like, although the present invention contemplates other materials as well. Once installed, the storm drain relief channel 28 of the present invention provides an alternate channel for water and debris to flow into a storm sewer or drain (in addition to the grate cover 16 associated with the curb inlet 10). This is especially useful, as the storm drain relief channel 28 is used to accommodate the 1-inch leave-down 26 associated with the storm sewer or drain. The opening defined by the top portion 30 of the storm drain relief channel 28 may be capped or otherwise plugged and paved over when later remedying this 1-inch leave-down.

Figure 5:
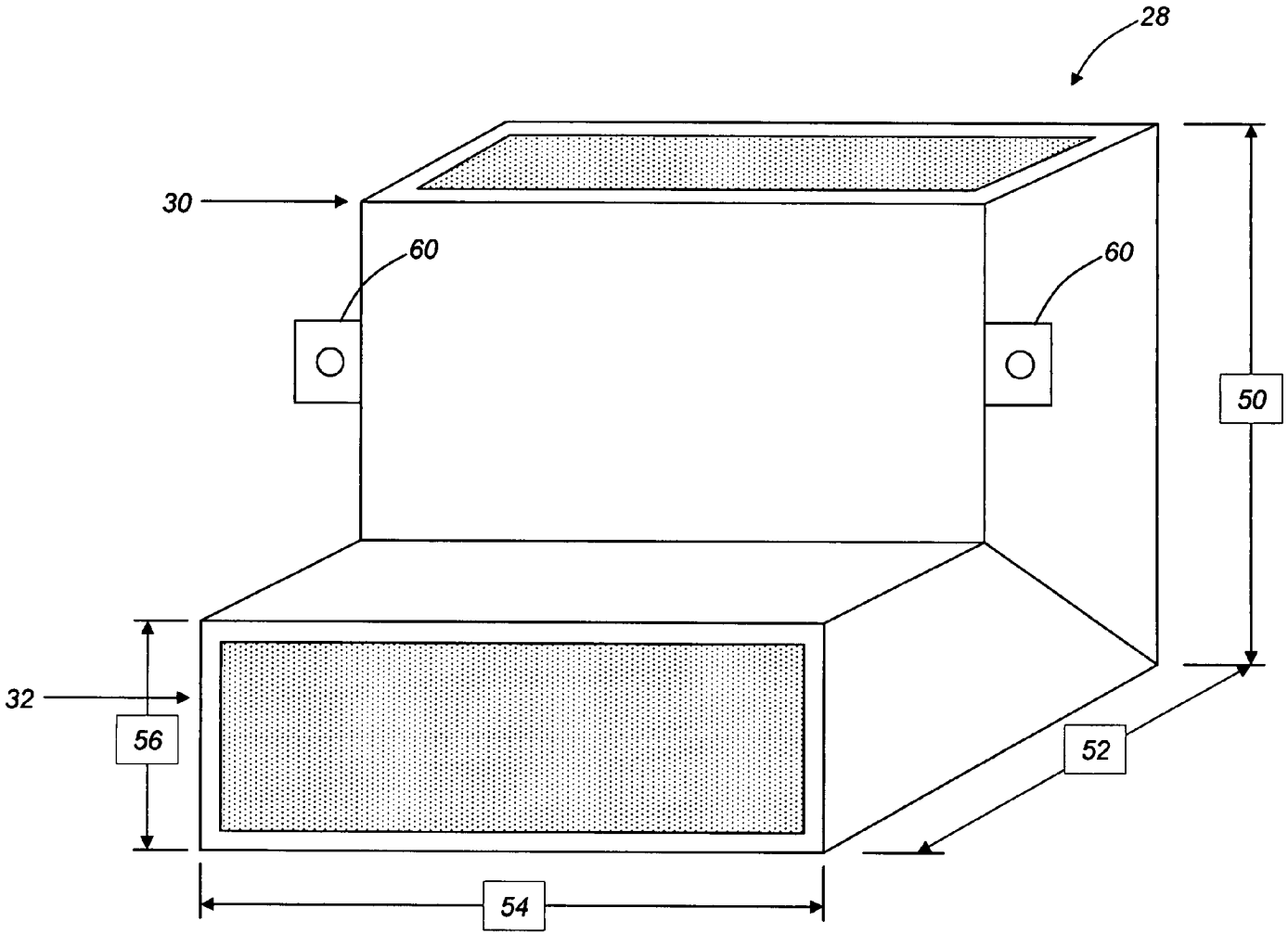
FIG. 5 is a perspective view of one exemplary embodiment of the storm drain relief channel of the present invention.
Figure 6:
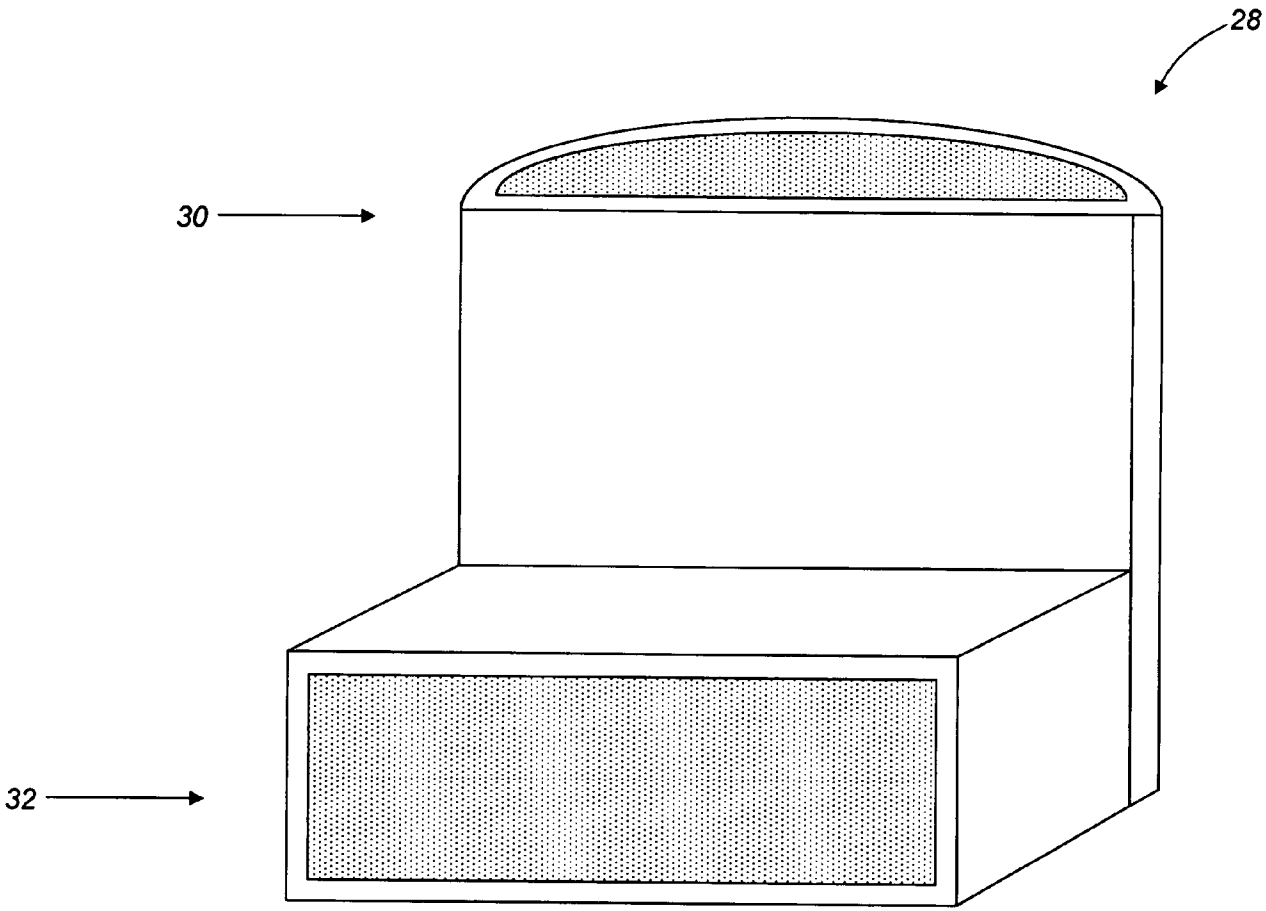
FIG. 6 is a perspective view of another exemplary embodiment of the storm drain relief channel of the present invention.
Figure 7:
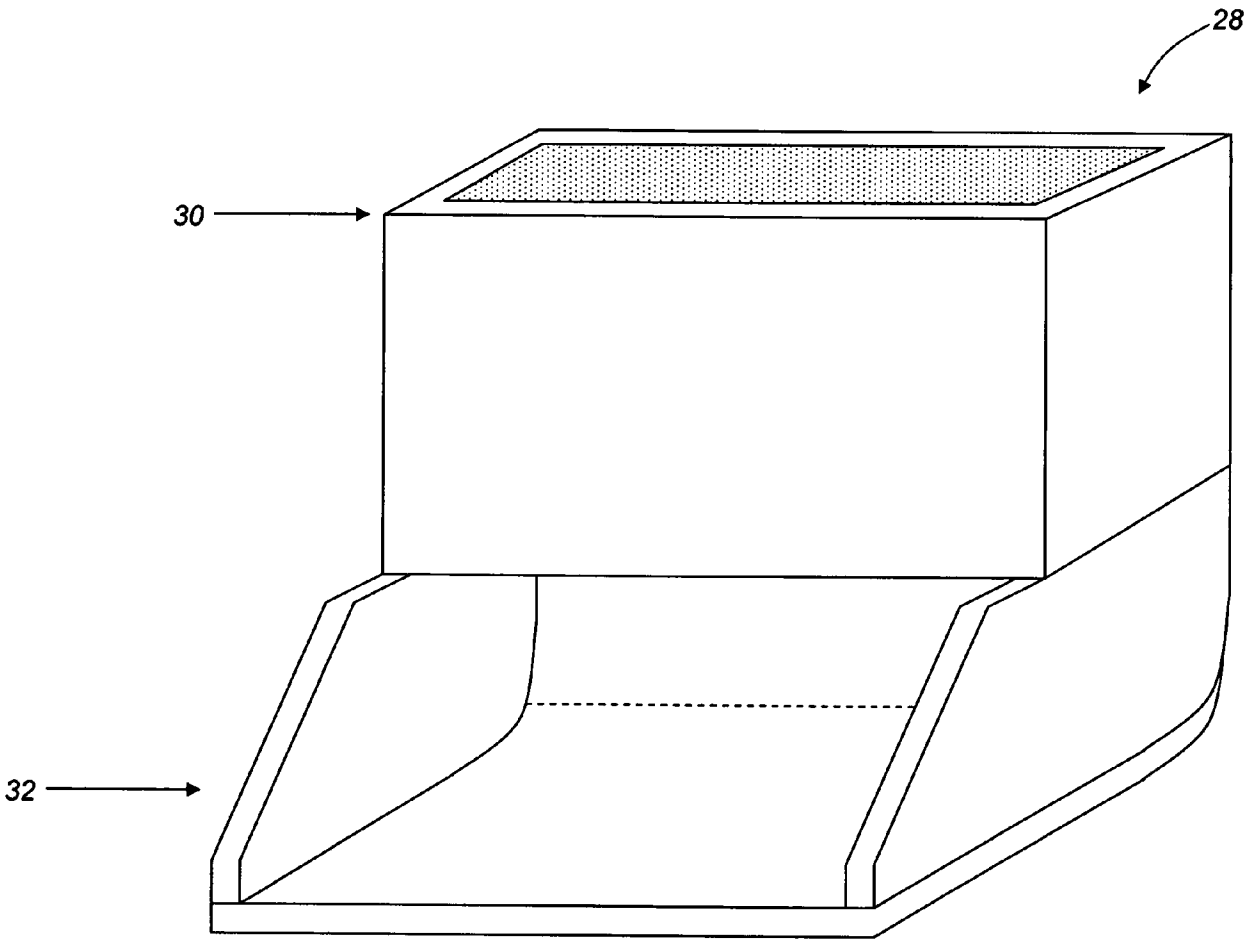
FIG. 7 is a perspective view of a further exemplary embodiment of the storm drain relief channel of the present invention.

Referring to FIGS. 5-7, several alternative embodiments of the storm drain relief channel 28 of the present invention are illustrated. For example, FIG. 5 illustrates a squared or rounded edge embodiment, which is relatively simple and inexpensive to manufacture. The storm drain relief channel 28 has an overall height 50 of between about 3 inches and about 10 inches, as well as an overall length 52 of between about 3 inches and about 10 inches, although other suitable dimensions may be used. Likewise, the openings of the storm drain relief channel 28 have an overall width 54 of between about 6 inches and about 12 inches, and an overall height 56 of between about 1 inch and about 3 inches, although other suitable dimensions may be used.

Optionally, the storm drain relief channel 28 is formed from one-piece tubular stock from which a piece is cut prior to folding and welding. Other suitable methods of manufacture are contemplated by the present invention. Optionally, the storm drain relief channel 28 includes one or more tabs 60 which may be used to secure the storm drain relief channel 28 to the low, or road, side 18 (FIGS. 1-4) of the rigid box structure 14 (FIGS. 1-4). Ties and/or mortar are also suitable for this purpose.

FIG. 6 illustrates a more refined, rounded embodiment, which helps to prevent vehicles and objects moving across the surface of the sub-grade and/or stonebase from catching the edges of the storm drain relief channel 28. Finally, FIG. 7 illustrates an even more refined, open embodiment, which helps to prevent clogging. Other shapes and configurations are contemplated by the present invention. Any of the embodiments may also incorporate one or more cross-members or grates (not illustrated) to prevent vehicles and objects moving across the surface of the asphalt road from partially or wholly entering the openings of the storm drain relief channel 28. This is important in relation to, for example, the tires of a bicycle or the like.

Referring again to FIG. 3, optionally, the storm drain relief channel 28 includes one or more clips 70 which may be used to secure the storm drain relief channel 28 to the low, or road, side 18 of the rigid box structure 14. Again, ties and/or mortar are also suitable for this purpose.

Figure 8:
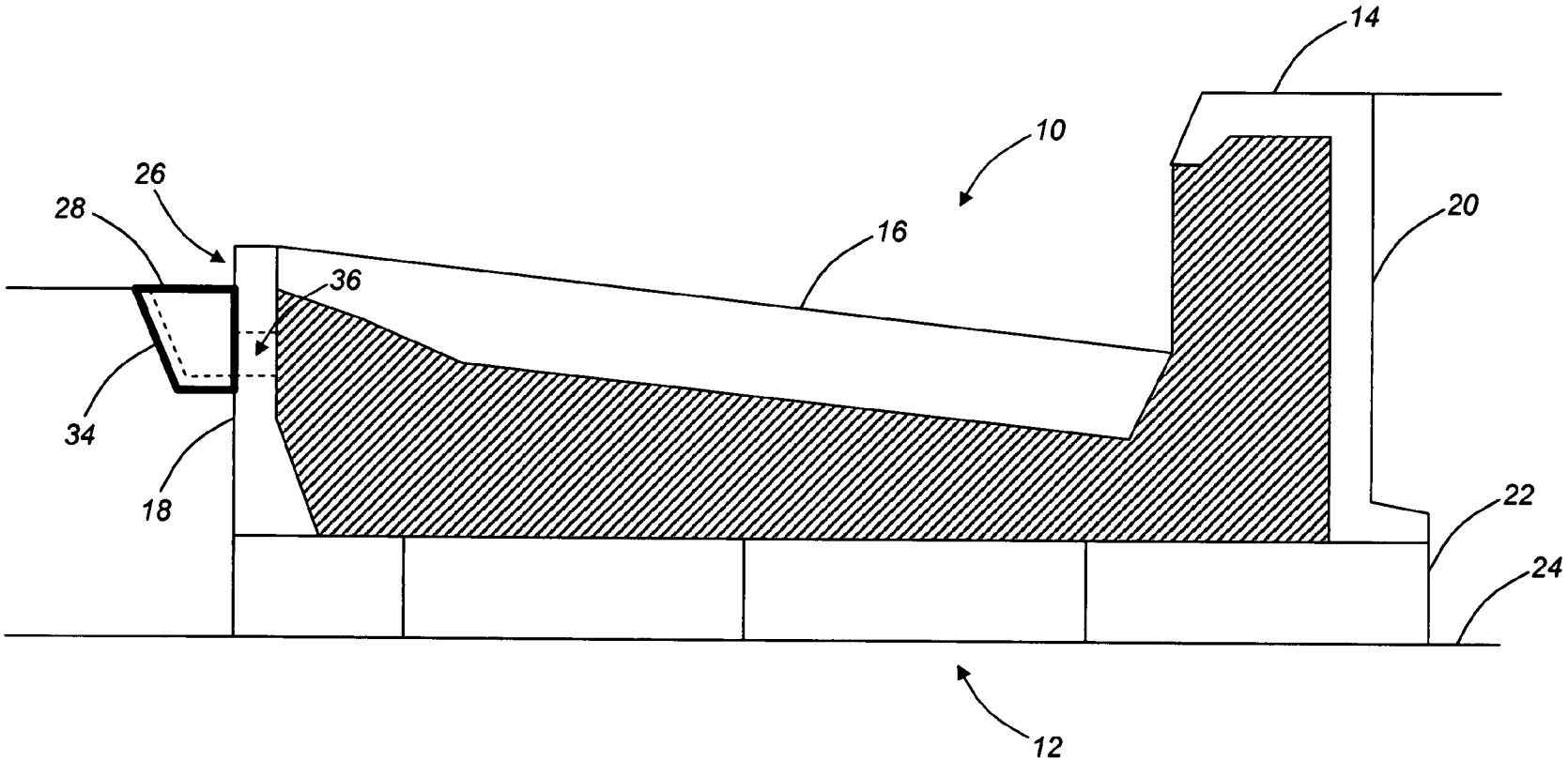

Referring to FIG. 8, in another alternative embodiment, the storm drain relief channel 28 of the present invention consists of a trough structure 34 or the like that is disposed adjacent to or integrally formed with the low, or road, side 18 of the rigid box structure 14 of the curb inlet 10. One or more passages or holes 36 are drilled through or formed in the low, or road, side 18 of the rigid box structure 14, their location substantially corresponding to the location of the trough structure 34. The one or more passages or holes 36 provide an alternate channel for water and debris to flow into a curb inlet and/or catch basin 12 (in addition to the grate cover 16 associated with the curb inlet 10). Again, this is especially useful, as the storm drain relief channel 28 is used to accommodate the 1-inch leave-down 26 associated with the curb inlet 10. The opening defined by the top portion of the trough structure 34 may be capped or otherwise plugged and paved over when later remedying this 1-inch leave-down.

Figure 9:
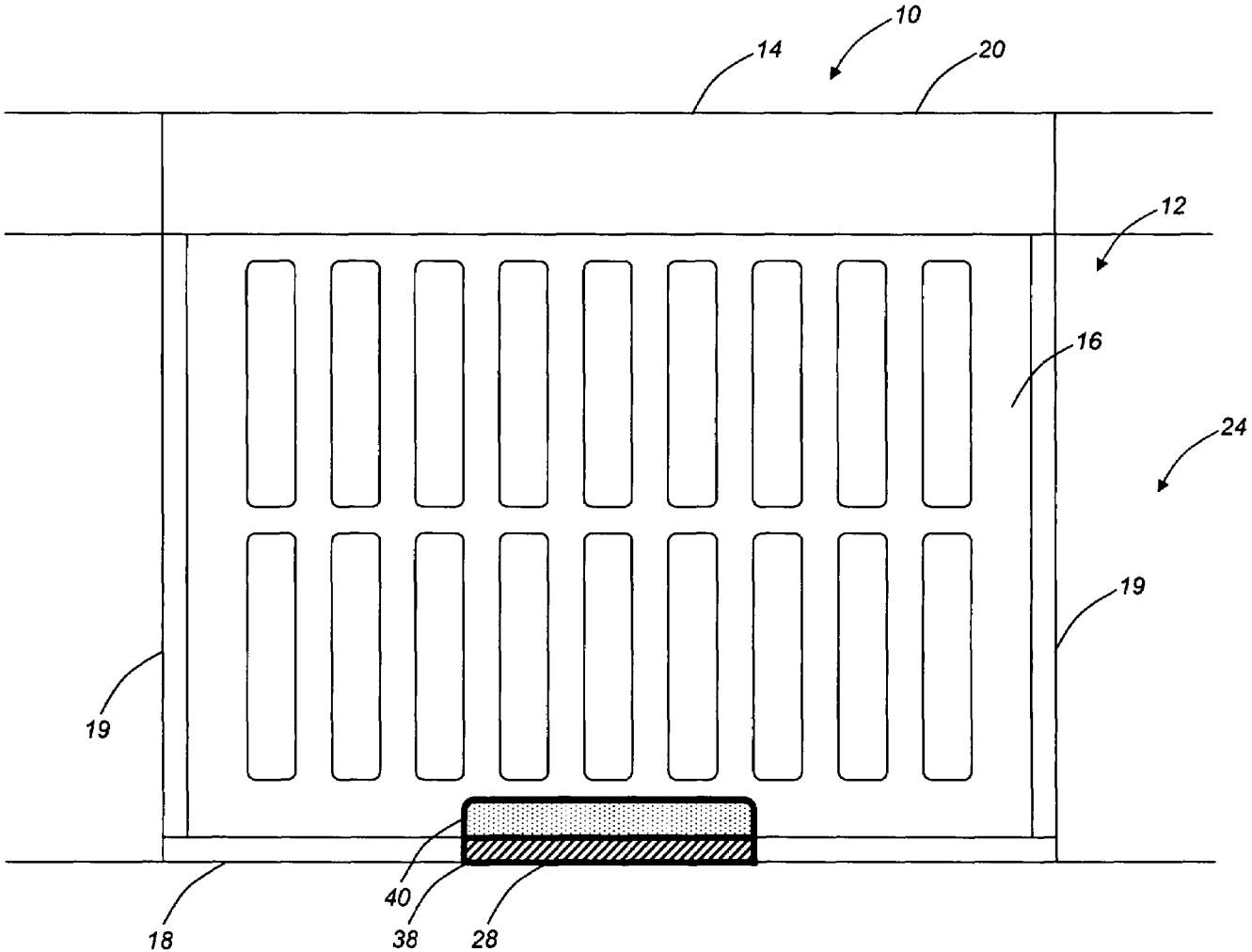

Referring to FIG. 9, in a further alternative embodiment, the storm drain relief channel 28 of the present invention consists of a pair of substantially-corresponding cutaways or recesses 38 and 40 in the low, or road, side 18 of the rigid box structure 14 of the curb inlet 10 and the grate cover 16. Preferably, the recessed portion 38 along the edge of the rigid box structure 14 has a depth of between about 1 inch and about 3 inches.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the invention and are intended to be covered by the following claims.

What is claimed is:

1. A storm drain relief channel for providing fluid/debris access from the surface of a road to the interior portion of a catch basin including a rigid box structure and an open portion beneath the rigid box structure, the storm drain relief channel comprising:

a substantially-hollow channel structure disposed adjacent to the rigid box structure of a curb inlet, the substantially-hollow channel structure having a first end defining a first opening and a second end defining a second opening, wherein the first end is configured to be disposed adjacent to and substantially flush with, and in fluid/debris communication with, the surface of the road and the second end is configured to be disposed one of adjacent to and within, and in fluid/debris communication with, the interior portion of the catch basin beneath the rigid box structure of the curb inlet.

2. The storm drain relief channel of claim 1, wherein the substantially-hollow channel structure is selectively attached to the rigid box structure of the curb inlet.

3. The storm drain relief channel of claim 2, wherein the substantially-hollow channel structure is selectively attached to the rigid box structure of the curb inlet using one or more of a clip, a tab, a tie, and mortar.

4. The storm drain relief channel of claim 1, wherein the substantially-hollow channel structure and the rigid box structure of the curb inlet are integrally formed.

5. The storm drain relief channel of claim 1, wherein the first end of the substantially-hollow channel structure defining the first opening is disposed approximately 1 inch below a surface of the rigid box structure of the curb inlet.

6. A method for installing/manufacturing a storm drain relief channel for providing access from the surface of a road to the interior portion of a catch basin including a rigid box structure and an open portion beneath the rigid box structure, the method comprising:

disposing a substantially-hollow channel structure adjacent to the rigid box structure of a curb inlet, the substantially-hollow channel structure having a first end defining a first opening and a second end defining a second opening, wherein the first end is configured to be disposed adjacent to and substantially flush with, and in fluid/debris communication with, the surface of the road and the second end is configured to be disposed one of adjacent to and within, and in fluid/debris communication with, the interior portion of the catch basin beneath the rigid box structure of the curb inlet.

7. The method of claim 6, further comprising selectively attaching the substantially-hollow channel structure to the rigid box structure of the curb inlet.

8. The storm drain relief channel of claim 7, further comprising selectively attaching the substantially-hollow channel structure to the rigid box structure of the curb inlet using one or more of a clip, a tab, a tie, and mortar.

9. The method of claim 6, further comprising integrally forming the substantially-hollow channel structure and the rigid box structure of the curb inlet.

10. The method of claim 6, wherein the first end of the substantially-hollow channel structure defining the first opening is disposed approximately 1 inch below a surface of the rigid box structure of the curb inlet.

11. A storm drain relief channel for providing access from the surface of a road to the interior portion of a catch basin including a rigid box structure and an open portion beneath the rigid box structure, the storm drain relief channel comprising:

a substantially-hollow trough structure disposed adjacent to the rigid box structure of a curb inlet, the substantially-hollow trough structure having a first end defining a first opening and a second end defining a second opening, wherein the first end is configured to be disposed adjacent to and substantially flush with, and in fluid/debris communication with, the surface of the road and the second end is configured to be disposed adjacent to, and in fluid/debris communication with, one or more passages provided through the rigid box structure of the curb inlet and into the interior portion of the catch basin beneath the rigid box structure of the curb inlet.

12. The storm drain relief channel of claim 11, wherein the substantially-hollow trough structure is selectively attached to the rigid box structure of the curb inlet.

13. The storm drain relief channel of claim 12, wherein the substantially-hollow channel structure is selectively attached to the rigid box structure of the curb inlet using one or more of a clip, a tab, a tie, and mortar.

14. The storm drain relief channel of claim 11, wherein the substantially-hollow trough structure and the rigid box structure of the curb inlet are integrally formed.

15. The storm drain relief channel of claim 11, wherein the first end of the substantially-hollow trough structure defining the first opening is disposed approximately 1 inch below a surface of the rigid box structure of the curb inlet.

* * * * *